US011732925B2

(12) United States Patent
Nozaki et al.

(10) Patent No.: US 11,732,925 B2
(45) Date of Patent: Aug. 22, 2023

(54) SCREEN COVER FOR ATTACHING TO OPEN END OF CONDUITS

(71) Applicant: Rheem Manufacturing Company, Atlanta, GA (US)

(72) Inventors: Takashi Nozaki, Pike Road, AL (US); Prudhvi Amaravadhi, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 398 days.

(21) Appl. No.: 17/124,974

(22) Filed: Dec. 17, 2020

(65) Prior Publication Data

US 2022/0196282 A1 Jun. 23, 2022

(51) Int. Cl.

| | |
|---|---|
| ***F24F 13/28*** | (2006.01) |
| ***F24F 13/20*** | (2006.01) |
| ***F24F 5/00*** | (2006.01) |

(52) U.S. Cl.

CPC ..... *F24F 13/28* (2013.01); *F24F 5/0096* (2013.01); *F24F 13/20* (2013.01)

(58) Field of Classification Search

CPC ..... F24F 13/28; F24F 5/0096; F24F 13/20; F24F 13/082

USPC ..... 55/490; 220/371, 372

See application file for complete search history.

(56) References Cited

U.S. PATENT DOCUMENTS

| | | | | |
|---|---|---|---|---|
| 8,496,515 | B2 | 7/2013 | Bailey | |
| 10,539,321 | B2 | 1/2020 | Ilin | |
| 2011/0254266 | A1* | 10/2011 | Guzowski | F16L 37/0842 285/374 |
| 2015/0362209 | A1 | 12/2015 | Dolan | |
| 2016/0201946 | A1 | 7/2016 | Shaffer et al. | |
| 2021/0239355 | A1* | 8/2021 | Dolan | F24F 13/082 |

FOREIGN PATENT DOCUMENTS

| | | | |
|---|---|---|---|
| CA | 1264622 | A1 | 1/1990 |
| CN | 208635251 | U * | 3/2019 |
| KR | 20170061208 | A * | 11/2015 |

OTHER PUBLICATIONS

International Search Report and Written Opinion for PCT Application No. PCT/US2021/063656 dated Apr. 7, 2022.

* cited by examiner

*Primary Examiner* — Robert A Hopkins
*Assistant Examiner* — Qianping He
(74) *Attorney, Agent, or Firm* — Eversheds Sutherland (US) LLP

(57) ABSTRACT

A screen cover for attaching to an open end of a conduit of a water heater is provided. The screen cover includes a first diametric portion having a first diameter and a second diametric portion having a second diameter. The first diameter is greater than the second diameter. The first and second diametric portions are coaxially aligned and configured to allow flow of air or gas therethrough. The screen cover includes a shoulder portion defined between the first diametric portion and the second diametric portion. The screen cover further includes a mesh disposed at a first opening of the first diametric portion. The mesh prevents entry of external objects into the water heater through the open end of the conduit.

19 Claims, 10 Drawing Sheets

SCREEN COVER FOR ATTACHING TO OPEN END OF CONDUITS

TECHNICAL FIELD

The present disclosure relates, in general, to water heaters and, more specifically relates, to screen covers for attaching to an open end of conduits of the water heaters.

BACKGROUND

Water heaters used in residential, commercial, and industrial applications exchange air and gases with atmosphere during operation. Conduits are used for routing air and gases between the water heaters and atmosphere. Such conduits include an open end exposed to atmosphere for exchanging gases and air. External objects, such as birds, animals, insects, and debris may enter the water heater through the open end of the conduits and hinder the operation of the water heater. External objects may also impact the flow of air and gases through the conduit by clogging therein. In various applications, the open end may include different configurations, such as straight pipe end, 45 degrees elbow end, and 90 degrees elbow end. A protective cap specific to various such pipes may be installed at the open end thereof to prevent entry of external objects. However, designing such protective cap separately for each configuration of the pipes may incur high cost in manufacturing and services.

SUMMARY

According to one aspect of the present disclosure, a screen cover for attaching to an open end of a conduit of a water heater is disclosed. The screen cover includes a first diametric portion having a first diameter defining a first opening. The first diametric portion includes a first outer surface defining the first diameter. The first diameter of the first diametric portion is in a range of about 55 mm to about 65 mm. The first outer surface is configured to engage with an inner surface of the open end of the conduit. The first diametric portion further includes a flange extending radially outward from the first outer surface thereof and is proximate the first opening. The flange is configured to abut a peripheral edge of the open end of the conduit. The screen cover includes a second diametric portion having a second diameter defining a second opening. The second diameter of the second diametric portion is in a range of about 45 mm to about 55 mm. Further, a length of the screen cover defined between the first opening of the first diametric portion and the second opening of the second diametric portion is in a range of about 10 mm to about 50 mm. In an embodiment, the second diametric portion includes an inner surface configured to engage with an outer surface of the open end of the conduit and a protrusion extending radially inward from the inner surface of the second diametric portion. The protrusion is configured to abut a peripheral edge of the open end of the conduit. The first diameter of the first diametric portion is greater than the second diameter of the second diametric portion. The first diametric portion and the second diametric portion are coaxially aligned and configured to allow flow of air or gas therethrough.

The screen cover also includes a shoulder portion defined between the first diametric portion and the second diametric portion. In one embodiment, the shoulder portion includes an inclined surface extending inward with respect to a longitudinal axis of the screen cover and a planar surface extending radially inward between the inclined surface and the second diametric portion. A juncture defined by the planar surface and the second diametric portion is configured to detach the second diametric portion from the first diametric portion. In another embodiment, the shoulder portion includes a tapered surface and a groove at a juncture of the tapered surface and the second diametric portion. The groove is configured to detach the second diametric portion from the first diametric portion. In an embodiment, the second diametric portion includes a second outer surface defining the second diameter. The second outer surface is configured to engage with an inner surface of the open end of the conduit and a peripheral edge of the open end of the conduit abuts the planar surface of the shoulder portion. The first outer surface of the first diametric portion or the second outer surface of the second diametric portion is configured to engage with the open end of the conduit using an interference fit.

The screen cover further includes a mesh disposed at the first opening of the first diametric portion and is configured to prevent entry of external objects into the water heater through the open end of the conduit. In one embodiment, the mesh is integral with the first diametric portion of the screen cover. In another embodiment, the mesh is detachably attached to the first diametric portion of the screen cover. The first diametric portion, the second diametric portion, the shoulder portion, and the mesh are made of plastic material comprising polyvinyl chloride (PVC). In certain embodiments, at least a portion of a wall of the second diametric portion is formed as a mesh. Therefore, the wall of the second diametric portion allows unobstructed flow of air or gas when the first diametric portion is engaged with the open end of the conduit. Further, at least some of the shoulder portion is formed as a mesh. At least the portion of the wall of the second diametric portion and the at least some of the shoulder portion are together configured to permit a flow of air therethrough, when the first diametric portion is engaged with the open end of the conduit.

According to another aspect of the present disclosure, a water heater is disclosed. The water heater includes a tank and one or more conduits fluidly coupled to the tank and configured to allow flow of air or gas therethrough. The water heater further includes one or more screen covers for removably attaching to an open end of the one or more conduits. Each screen cover includes a first diametric portion having a first outer diameter defining a first opening and a second diametric portion having a second outer diameter defining a second opening. The first outer diameter of the first diametric portion is greater than the second outer diameter of the second diametric portion. The first diametric portion and the second diametric portion are coaxially aligned and configured to allow flow of the air or gas therethrough.

Each screen cover also includes a shoulder portion defined between the first diametric portion and the second diametric portion. In one embodiment, the first diametric portion is configured to engage with the open end of the conduit having an inner diameter equal to the first outer diameter of the first diametric portion and a peripheral edge of the open end of the conduit abuts a flange extending radially outward from a first outer surface of the first diametric portion. In another embodiment, the second diametric portion is configured to engage with the open end of the conduit having an inner diameter equal to the second outer diameter of the second diametric portion and a peripheral edge of the open end of the conduit abuts the shoulder portion. In yet another embodiment, the second diametric portion is configured to engage with the open end of the conduit having an outer diameter equal to a diameter defined by an inner surface of the second diametric portion. A peripheral edge of the open end of the conduit abuts a protrusion extending radially inward from the inner surface of the second diametric portion. Each screen cover further includes a mesh disposed at the first opening of the first diametric portion and configured to prevent entry of external objects into the water heater through the open end of the conduit.

These and other aspects and features of non-limiting embodiments of the present disclosure will become apparent to those skilled in the art upon review of the following description of specific non-limiting embodiments of the disclosure in conjunction with the accompanying drawings.

BRIEF DESCRIPTION OF THE DRAWINGS

A better understanding of embodiments of the present disclosure (including alternatives and/or variations thereof) may be obtained with reference to the detailed description of the embodiments along with the following drawings, in which.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Figure 1:
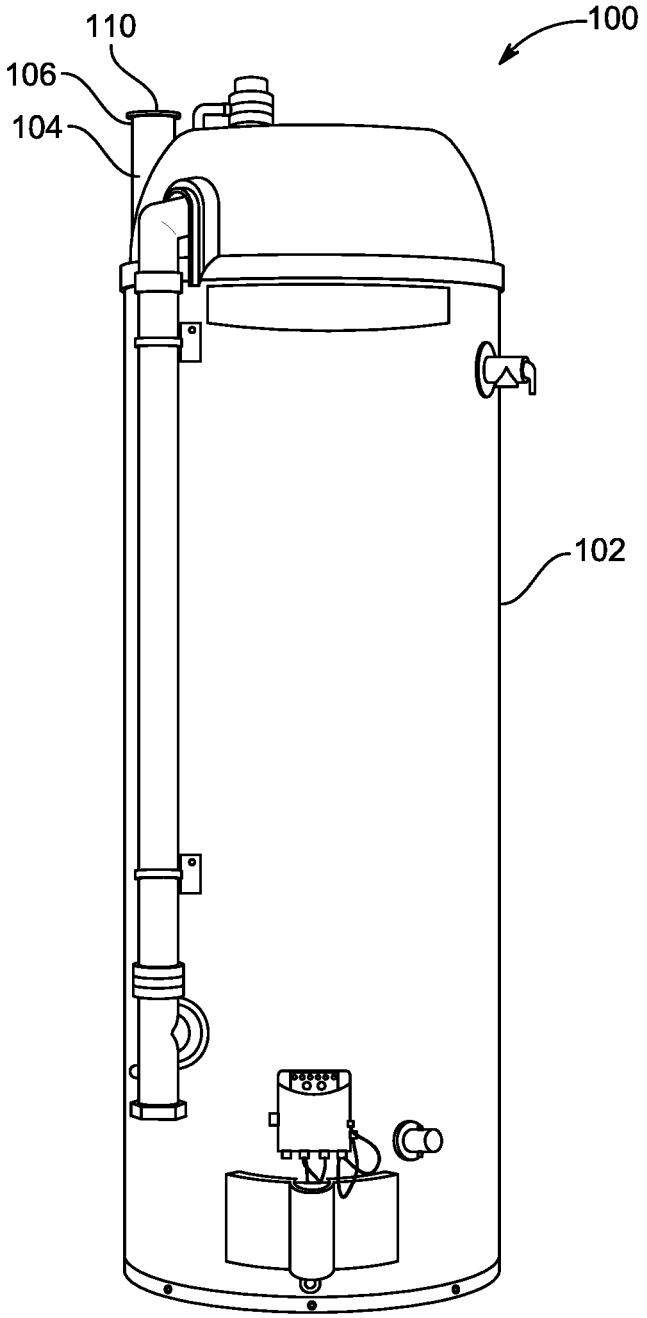
FIG. 1 is a perspective view of a water heater having a screen cover attached to a conduit, according to an embodiment of the present disclosure.

Referring to FIG. 1, a perspective view of a water heater 100 is illustrated, according to an embodiment of the present disclosure. The water heater 100 may be a fuel fired water heater which may be used in residential, commercial or industrial applications. The water heater 100 may be fired using either gaseous fuel or liquid fuel to generate heat. In one implementation, the water heater 100 may be a gas-fired condensing water heater in which heat is transferred to water through a condensing heat exchanger. The water heater 100 includes a tank 102 for storing water to be heated and a combustion chamber for combustion of fuel therein to generate heat.

The water heater 100 further includes one or more conduits 104 defining a passage along a length thereof. The one or more conduits 104 are fluidly coupled to the tank 102 and configured to allow flow of air or gas therethrough. More specifically, the water heater 100 may include a conduit 104 for allowing flow of air to the tank 102 and another conduit 104 for exiting gas from the tank 102 of the water heater 100. The conduit 104 includes an open end 106 configured to receive the air or exit the gas therethrough. In one implementation, the conduit 104 may be a straight pipe having an inner diameter of about 3 inches. In another implementation, the conduit 104 may be an elbow pipe, such as a 90 degrees elbow or a 45 degrees elbow, having an inner diameter of about 1.5 inches.

The water heater 100 further includes one or more screen covers 110 configured to attach with the open end 106 of the one or more conduits 104. The one or more screen covers 110 are configured to prevent entry of external subjects such as birds or insects into the water heater 100 through the open end 106 of the one or more conduits 104 while allowing flow of air or gas therethrough. The screen cover 110 is described in detail herein below with reference to FIG. 2A through FIG. 2C.

Figure 2A:
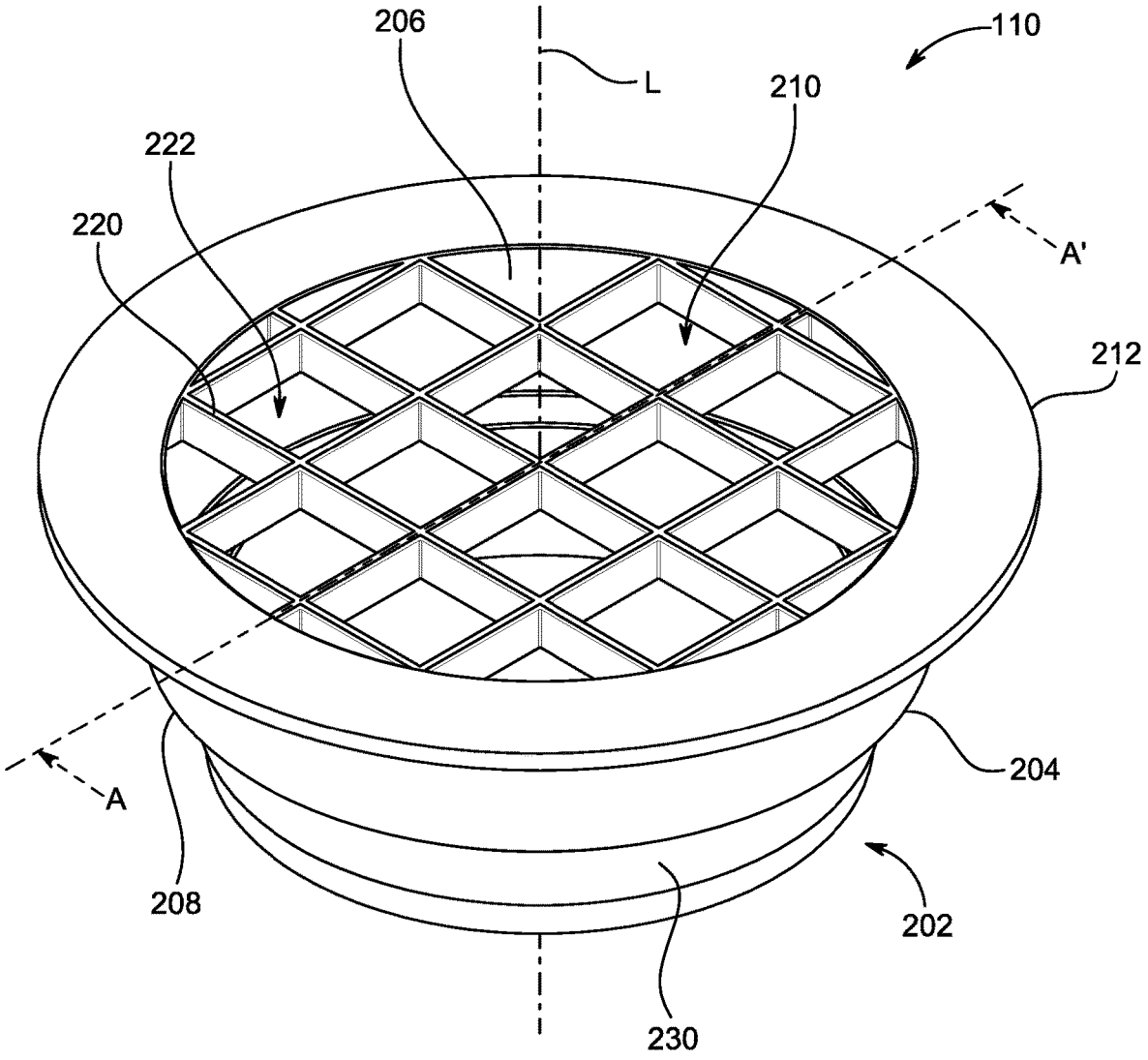
FIG. 2A is a top perspective view of the screen cover, according to an embodiment of the present disclosure.

FIG. 2A illustrates a top perspective view of the screen cover 110, according to an embodiment of the present disclosure. The screen cover 110 includes a body 202 defining a longitudinal axis 'L'. The body 202 of the screen cover 110 is made of plastic materials such as, but are not limited to, Polyvinyl Chloride (PVC) or Polypropylene (PP). The body 202 includes a first diametric portion 204 extending along the longitudinal axis 'L' and includes a top end and a bottom end. The first diametric portion 204 includes a first inner surface 206 and a first outer surface 208 opposite to the first inner surface 206. Further, the first diametric portion 204 defines a first opening 210 at the top end thereof to allow flow of air or gas therethrough. More specifically, the first opening 210 extends along a length of the first diametric portion 204.

The first diametric portion 204 further includes a flange 212 extending radially outward from the first outer surface 208 proximate the top end thereof. In an embodiment, the flange 212 may circumferentially extend, about the longitudinal axis 'L', around the first opening 210 of the first diametric portion 204. In another embodiment, the flange 212 may be multiple individual extensions around the first opening 210 of the first diametric portion 204. The flange 212 is configured to about a peripheral edge (shown in FIG. 5) of the open end 106 of the conduit 104 when the screen cover 110 is attached to the conduit 104.

The screen cover 110 further includes a mesh 220 disposed at the first opening 210 of the first diametric portion 204. Particularly, the mesh 220 is disposed proximate the top end of the first diametric portion 204. In an embodiment, the mesh 220 is integral with the first diametric portion 204. In such implementation, the first diametric portion 204 and the mesh 220 may be molded as a single piece from a plastic material. In another embodiment, the mesh 220 may be detachably attached to the first diametric portion 204. In such implementation, various fastening mechanisms such as fasteners, snap fit and interference fit may be used to couple the mesh 220 with the first diametric portion 204. In some embodiments, the mesh 220 may include external threads adapted to engage with corresponding threads provided in the first diametric portion 204.

In an embodiment, the mesh 220 may radially extend across the first opening 210 of the first diametric portion 204. The mesh 220 includes multiple openings 222 for passage of air or gas therethrough. In one implementation, the openings 222 may have square shapes. However, it may be understood that size and shape of each of the openings 222 may vary to allow passage of air or gas therethrough while preventing the external objects such as birds and insects from entering the water heater 100. In various implementations, the openings 222 may have various shapes including, but not limited to, oval, rectangular, hexagonal, and polygonal shapes.

Figure 2B:
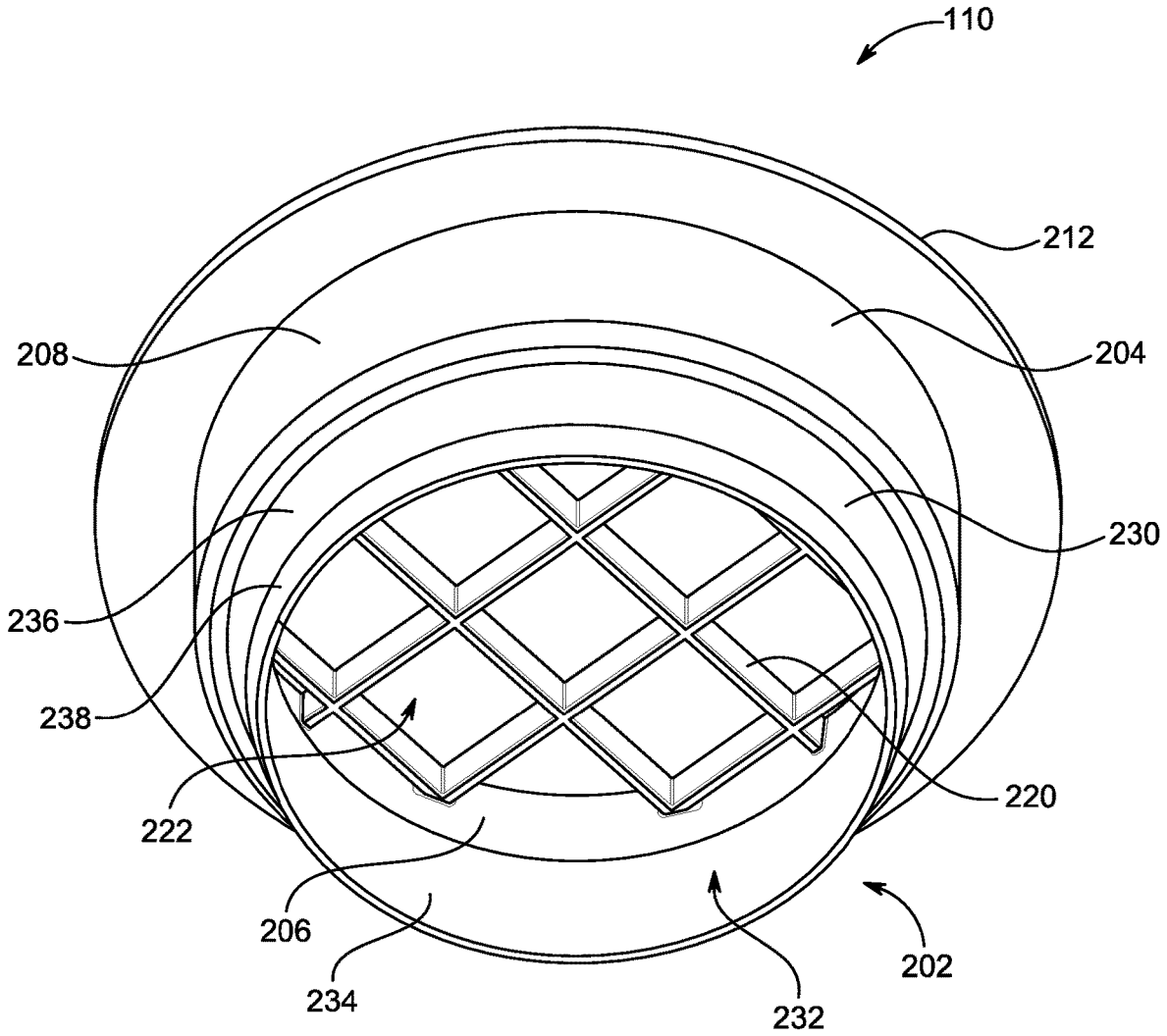
FIG. 2B is a bottom perspective view of the screen cover, according to an embodiment of the present disclosure.

FIG. 2B illustrates a bottom perspective view of the screen cover 110, according to an embodiment of the present disclosure. The screen cover 110 includes a second diametric portion 230 coaxially aligned with the first diametric portion 204 along the longitudinal axis 'L'. The first diametric portion 204 and the second diametric portion 230 are together configured to allow flow of air or gas therethrough. The second diametric portion 230 includes a top end, a bottom end, and a second opening 232 defined at the bottom end thereof to allow flow of air or gas therethrough. More specifically, the second opening 232 extends along a length of the second diametric portion 230.

The second diametric portion 230 further includes a second inner surface 234 and a second outer surface 236 opposite to the second inner surface 234. In an embodiment, the second outer surface 236 may include a tapered surface 238 proximate the bottom end of the second diametric portion 230. The tapered surface 238 may allow the second diametric portion 230 to freely receive within the open end 106 of the conduit 104 while attaching the screen cover 110 with the conduit 104.

Figure 2C:
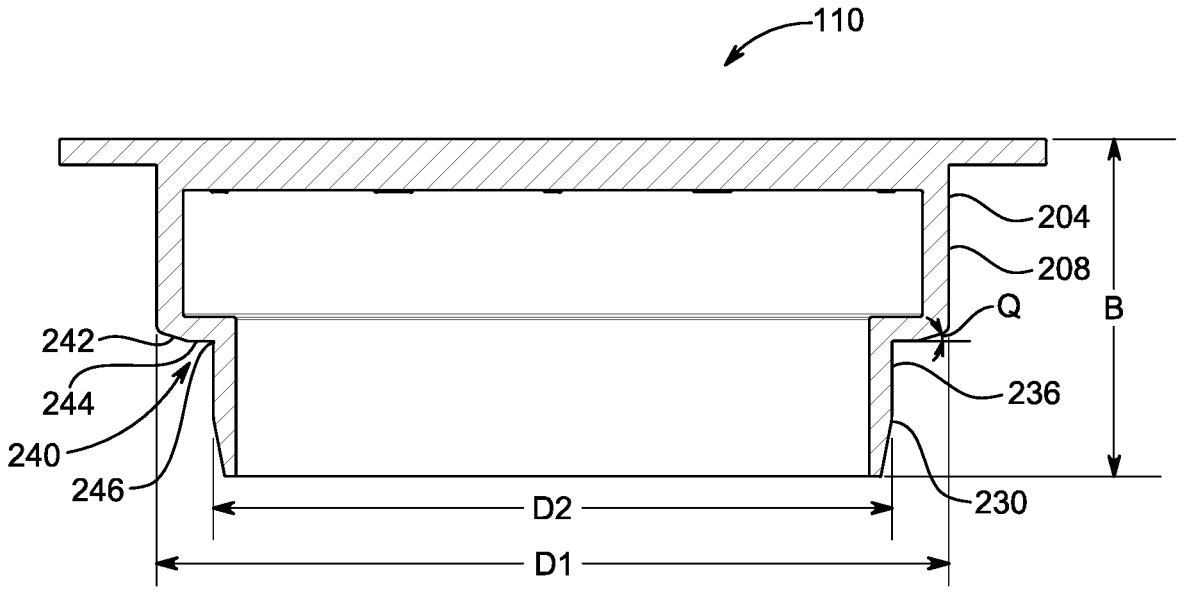
FIG. 2C is a sectional view of the screen cover taken along line A-A' of FIG. 2, according to an embodiment of the present disclosure.

FIG. 2C illustrates a sectional view of the screen cover 110 taken along a line A-A' of FIG. 2A, according to an embodiment of the present disclosure. The first outer surface 208 of the first diametric portion 204 defines a first outer diameter 'D1', which is alternatively referred to as the first diameter 'D1' of the first diametric portion 204. The second outer surface 236 of the second diametric portion 230 defines a second outer diameter 'D2', which is alternatively referred to as the second diameter 'D2' of the second diametric portion 230. The first diameter 'D1' of the first diametric portion 204 is greater than the second diameter 'D2' of the second diametric portion 230. In an embodiment, the first diameter 'D1' of the first diametric portion 204 may be in a range of about 55 mm to about 65 mm and the second diameter 'D2' of the second diametric portion 230 may be in a range of about 45 mm to about 55 mm. Further, a length 'B' defined between the first opening 210 of the first diametric portion 204 and the second opening 232 of the second diametric portion 230 may be in a range of about 10 mm to about 50 mm.

Referring to FIG. 2A through FIG. 2C, the screen cover 110 further includes a shoulder portion 240 defined between the first diametric portion 204 and the second diametric portion 230. Particularly, the shoulder portion 240 extends between the bottom end of the first diametric portion 204 and the top end of the second diametric portion 230. The shoulder portion 240 includes an inclined surface 242 extending inwardly with respect to the longitudinal axis 'L' from the bottom end of the first diametric portion 204. In an example, the inclined surface 242 may extend inward with respect to the longitudinal axis 'L' at an angle 'Q'. The angle 'Q' may be defined based on the design and manufacturing requirements of the screen cover 110. The shoulder portion 240 also includes a planar surface 244 extending radially inward between the inclined surface 242 and the top end of the second diametric portion 230. The planar surface 244 and the second outer surface 236 of the second diametric portion 230 defines a juncture 246. The juncture 246 is configured to detach the second diametric portion 230 from the first diametric portion 204. The first diametric portion 204, the second diametric portion 230, the shoulder portion 240, and the mesh 220 are made of plastic material comprising polyvinyl chloride (PVC).

Figure 3:
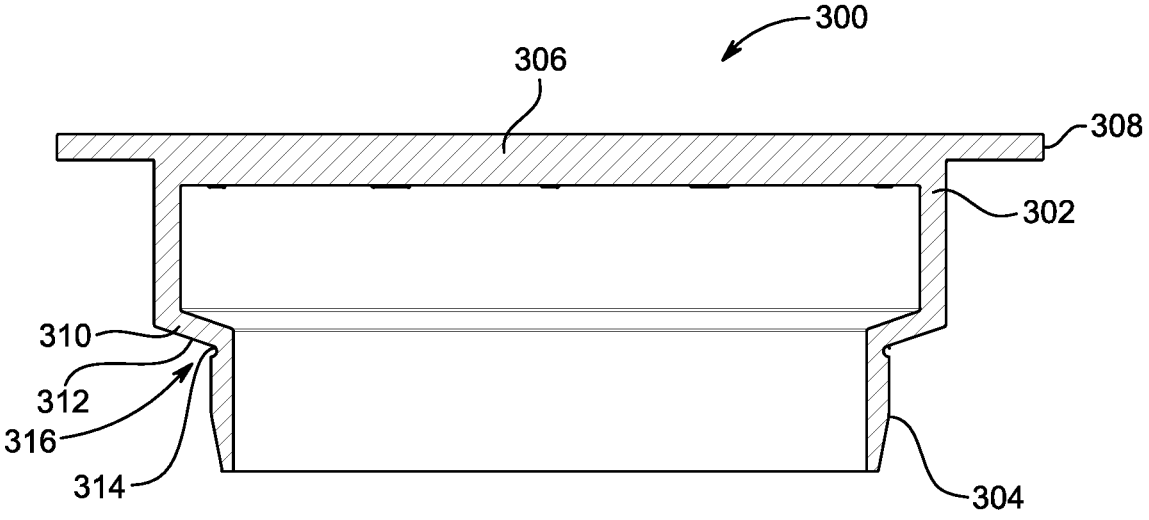
FIG. 3 is a sectional view of a screen cover, according to another embodiment of the present disclosure.

Referring to FIG. 3, a sectional view of a screen cover 300 is illustrated, according to another embodiment of the present disclosure. The screen cover 300 includes a first diametric portion 302, a second diametric portion 304, a mesh 306 and a flange 308. The construction and dimensional specification of the first diametric portion 302, the second diametric portion 304, the mesh 306 and the flange 308 are same as the first diametric portion 204, the second diametric portion 230, the mesh 220 and the flange 212 of the screen cover 110. The screen cover 300 includes a shoulder portion 310 extending between the first diametric portion 302 and the second diametric portion 304. More specifically, the shoulder portion 310 includes a tapered surface 312 extending between the first diametric portion 302 and the second diametric portion 304. The shoulder portion 310 further includes a groove 314 defined at a juncture 316 of the tapered surface 312 and the second diametric portion 304. The groove 314 is configured to detach the second diametric portion 304 from the first diametric portion 302. In one embodiment, the groove 314 may allow a user to detach the second diametric portion 304 by applying a pulling force. In another embodiment, the juncture 316 may include multiple incision lines that may allow a user to detach the second diametric portion 304 by applying a twisting force. In yet another embodiment, the juncture 316 may include markings indicating a cutting path such that a cutting tool may be used to detach the second diametric portion 304 from the first diametric portion 302.

Figure 4:
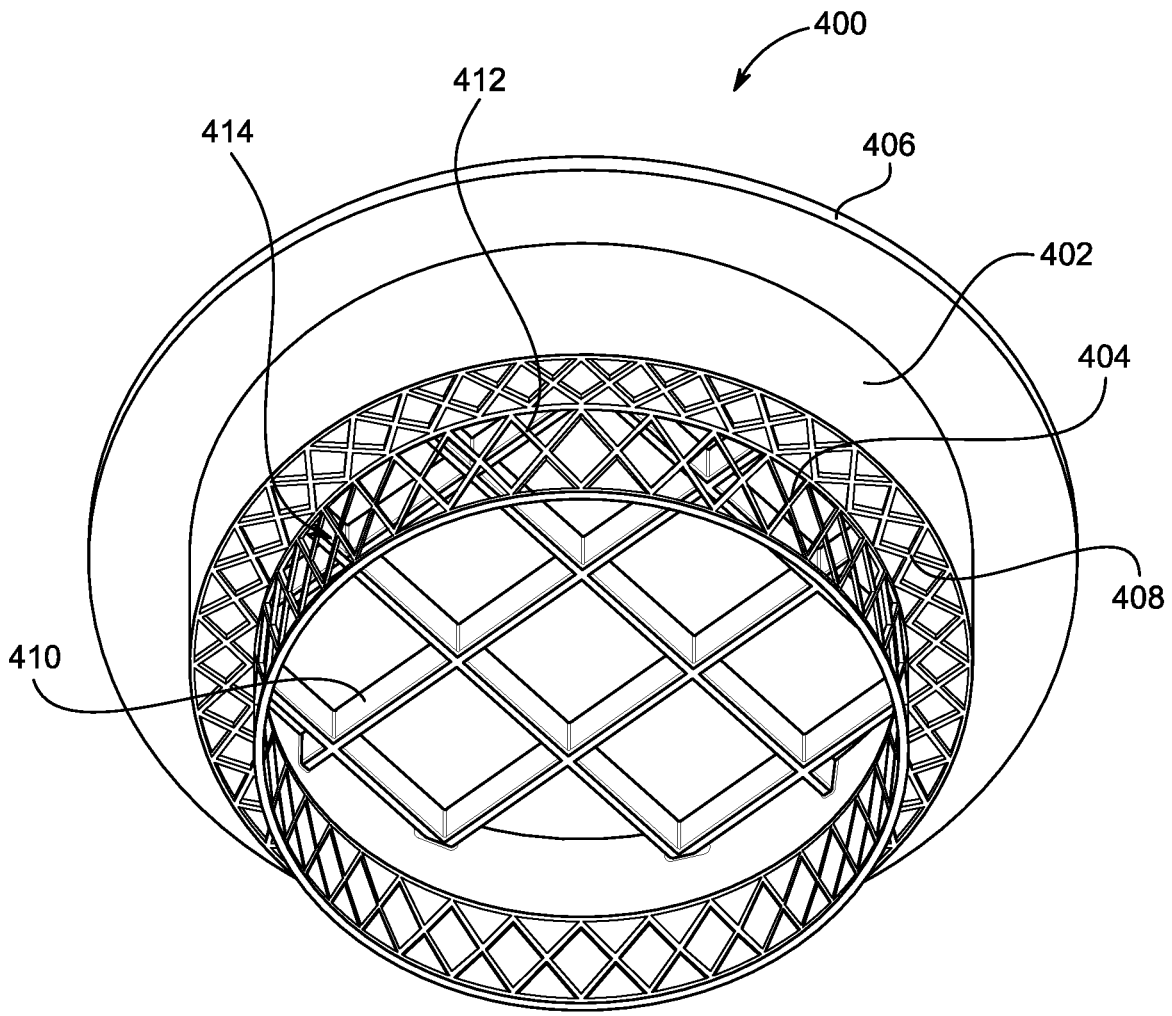
FIG. 4 is a perspective view of a screen cover, according to yet another embodiment of the present disclosure.

Referring to FIG. 4, a perspective view of a screen cover 400 is illustrated, according to an embodiment of the present disclosure. The screen cover 400 includes a first diametric portion 402 and a second diametric portion 404 coaxially aligned to each other identical to the construction of the screen cover 110. The screen cover 400 further includes a flange 406 and a shoulder portion 408 extending between the first diametric portion 402 and the second diametric portion 404. The construction and dimensional specification of the first diametric portion 402, the flange 406 and a mesh 410 are same as the first diametric portion 204, the mesh 220 and the flange 212 of the screen cover 110. The second diametric portion 404 includes a wall 412 and at least a portion of the wall 412 is formed as a mesh. Further, at least some of the shoulder portion 408 is formed as a mesh, thus at least the portion of the wall 412 of the second diametric portion 404 and at least some of the shoulder portion 408 may be together formed as mesh. The wall 412 defines multiple holes 414 configured to allow flow of air or gas therethrough. As such, the shoulder portion 408 and the wall 412 of the second diametric portion 404 are together configured to permit a flow of air therethrough, when the first diametric portion 402 is engaged with the open end 106 of the conduit 104. In one embodiment, the multiple holes 414 in the wall 412 may have square shapes similar to the openings 222 in the mesh 220. Further, size and shape of each of the holes 414 may vary to allow passage of air or gas. In various implementations, the holes 414 may have various shapes including, but not limited to, oval, rectangular, hexagonal, and polygonal shapes.

Figure 5:
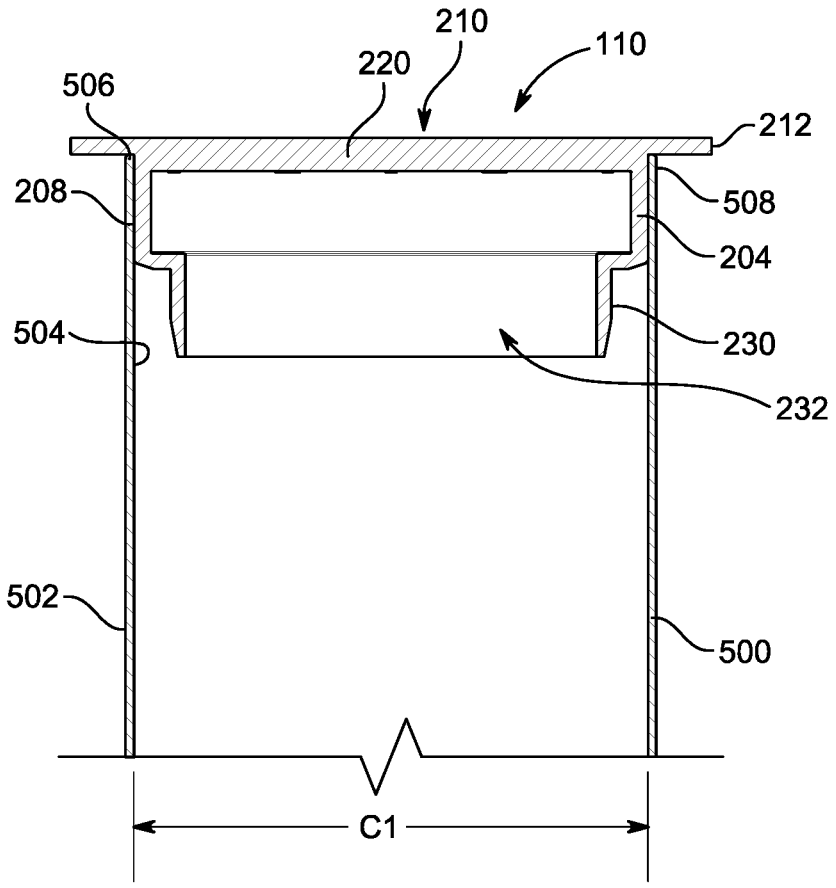
FIG. 5 is a cross-sectional view showing the screen cover attached with a conduit, according to one embodiment of the present disclosure.

FIG. 5 is a cross-sectional view showing the screen cover 110 attached with a conduit 500, according to one embodiment of the present disclosure. In the implementation shown in FIG. 5, the conduit 500 has an inner diameter 'C1' equal to the first outer diameter 'D1' of the first diametric portion 204. The conduit 500 includes a wall 502 defining an inner surface 504 which in turn defines the inner diameter 'C1'. The wall 502 includes a peripheral edge 506 at an open end 508 of the conduit 500. When the screen cover 110 is attached to the open end 508 of the conduit 500, the first diametric portion 204 of the screen cover 110 engages with the wall 502 of the conduit 500 as the first outer diameter 'D1' of the first diametric portion 204 is equal to the inner diameter 'C1' of the conduit 500. In an embodiment, an interference fit may be achieved between the first outer surface 208 of the first diametric portion 204 and the inner surface 504 of the conduit 500 for rigidly attaching the screen cover 110 with the conduit 500.

Further, the flange 212 of the screen cover 110 abuts the peripheral edge 506 of the conduit 500 such that the mesh 220 covers the open end 508 of the conduit 500. As such, the air enters through the openings 222 of the screen cover 110 during operation of the water heater 100. The air flows through the first opening 210 of the first diametric portion 204 and the second opening 232 of the second diametric portion 230 to enter the water heater 100. Due to the shape and size of the openings 222 in the mesh 220, the mesh 220 prevents entry of external objects such as birds or insects into the water heater 100 through the open end 508 of the conduit 500.

Figure 6:
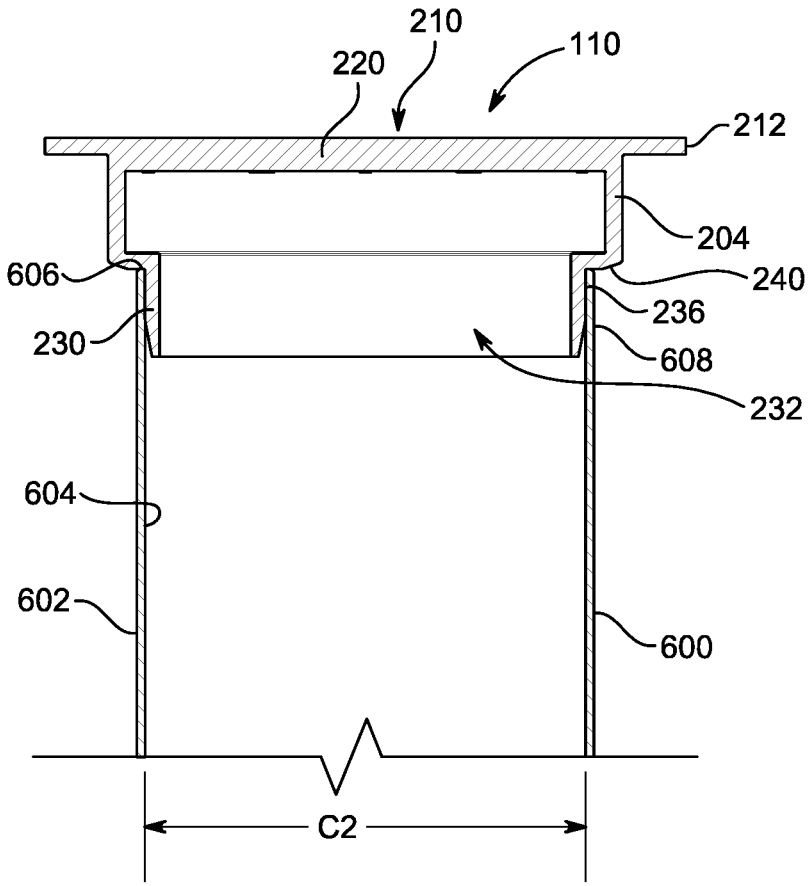
FIG. 6 is a cross-sectional view showing the screen cover attached with a conduit, according to another embodiment of the present disclosure.

FIG. 6 is a cross-sectional view showing the screen cover 110 attached with a conduit 600, according to another embodiment of the present disclosure. In the implementation shown in FIG. 6, the conduit 600 has an inner diameter 'C2' equal to the second outer diameter 'D2' of the second diametric portion 230. The conduit 600 includes a wall 602 defining an inner surface 604 which in turn defines the inner diameter 'C2'. The wall 602 includes a peripheral edge 606 at an open end 608 of the conduit 600. When the screen cover 110 is attached to the open end 608 of the conduit 600, the second diametric portion 230 of the screen cover 110 engages with the wall 602 of the conduit 600 as the second outer diameter 'D2' of the second diametric portion 230 is equal to the inner diameter 'C2' of the conduit 600. In an embodiment, an interference fit may be achieved between the second outer surface 236 of the second diametric portion 230 and the inner surface 604 of the conduit 600 for rigidly attaching the screen cover 110 with the conduit 600. Further, the shoulder portion 240 of the screen cover 110 abuts the peripheral edge 606 of the conduit 600 such that the mesh 220 along with the first diametric portion 204 covers the open end 608 of the conduit 600.

Figure 7:
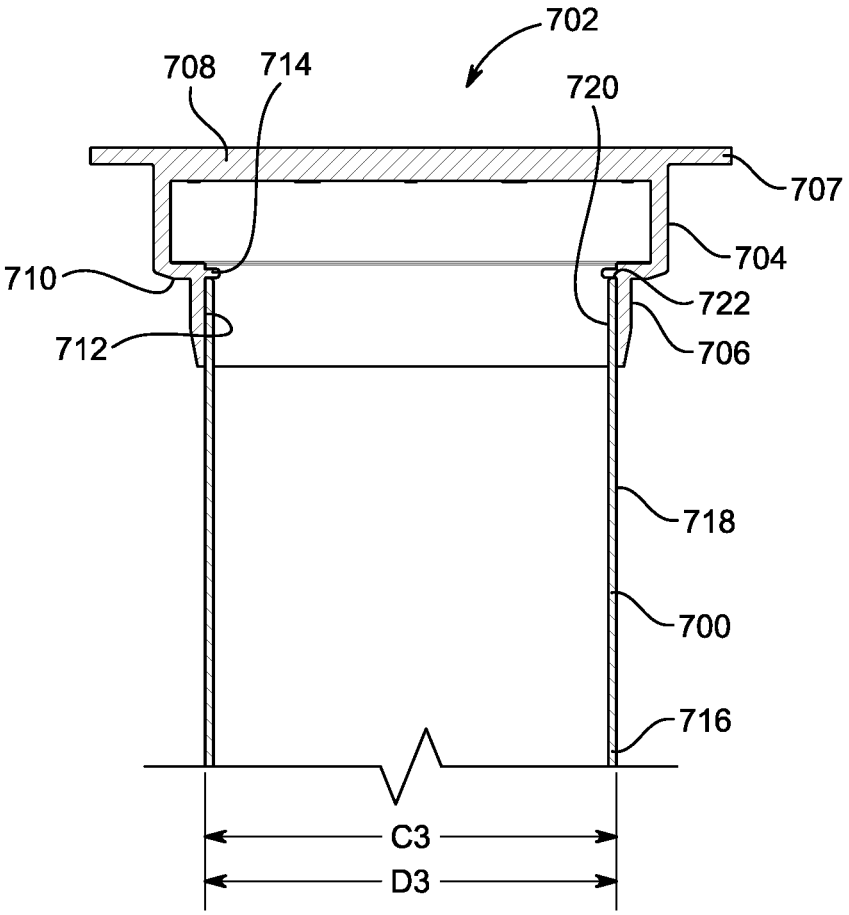
FIG. 7 is a cross-sectional view showing a screen cover attached with a conduit, according to yet another embodiment of the present disclosure.

FIG. 7 is a cross-sectional view showing attachment of a conduit 700 with a screen cover 702, according to yet another embodiment of the present disclosure. The screen cover 702 includes a first diametric portion 704, a second diametric portion 706, a flange 707, a mesh 708, and a shoulder portion 710. The construction and dimensional specification of the first diametric portion 704, the second diametric portion 706, the flange 707, the mesh 708, and the shoulder portion 710 are similar to the construction of the screen cover 110 illustrated in FIG. 2A though FIG. 2C. The second diametric portion 706 includes an inner surface 712 defining a diameter 'D3'. The second diametric portion 706 further includes a protrusion 714 extending radially inward from the inner surface 712. In an embodiment, the protrusion 714 is disposed adjacent to the shoulder portion 710 of the screen cover 702. The conduit 700 includes a wall 716 defining an outer surface 718 which in turn defines an outer diameter 'C3'. When the screen cover 702 is attached to an open end 720 of the conduit 700, the second diametric portion 706 of the screen cover 702 engages with the outer surface 718 of the conduit 700 as the diameter 'D3' of the second diametric portion 706 is equal to the outer diameter 'C3' of the conduit 700. Further, the protrusion 714 of the second diametric portion 706 abuts a peripheral edge 722 of the open end 720 of the conduit 700 to support the screen cover 702 on the conduit 700.

Figure 8:
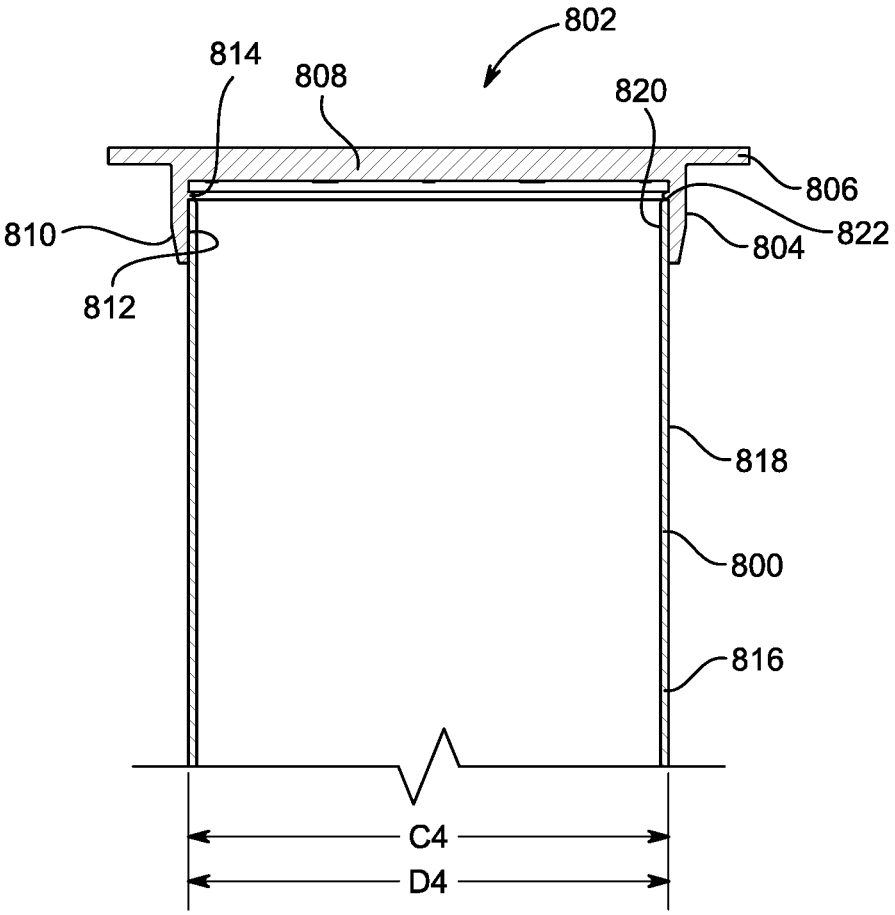
FIG. 8 is a cross-sectional view showing a screen cover attached with a conduit, according to yet another embodiment of the present disclosure.

FIG. 8 is a cross-sectional view showing attachment of a conduit 800 with a screen cover 802, according to an embodiment of the present disclosure. The screen cover 802 includes a diametric portion 804, a flange 806, and a mesh 808. The construction and dimensional specification of the diametric portion 804, the flange 806, and the mesh 808 are identical to the construction of the screen cover 110 illustrated in FIG. 2A though FIG. 2C except the second diametric portion 230 and the shoulder portion 240. The diametric portion 804 includes an inner surface 812 defining a diameter 'D4'. The diametric portion 804 further includes a protrusion 814 extending radially inward from the inner surface 812. In an embodiment, the protrusion 814 is disposed adjacent the flange 806 of the screen cover 802. The conduit 800 includes a wall 816 defining an outer surface 818 which in turn defines an outer diameter 'C4'. When the screen cover 802 is attached to an open end 820 of the conduit 800, the diametric portion 804 of the screen cover 802 engages with the outer surface 818 of the conduit 800 as the diameter 'D4' of the diametric portion 804 is equal to the outer diameter 'C4' of the conduit 800. Further, the protrusion 814 of the diametric portion 804 abuts a peripheral edge 822 of the open end 820 of the conduit 800 to support the screen cover 802 on the conduit 800.

INDUSTRIAL APPLICABILITY

The present disclosure relates to the screen cover 110 for attaching to the open end 106 of the conduit 104 for preventing external objects, such as insects and birds from entering the water heater 100. The application and advantages of the present disclosure is described with reference to the screen cover 110 although various embodiments of the screen cover are described above in detail. The screen cover 110 includes the first diametric portion 204, the second diametric portion 230 and the shoulder portion 240 extending between the first diametric portion 204 and the second diametric portion 230. The first diametric portion 204 or the second diametric portion 230 engages with the open end 106 of the conduit 104 based on inner diameter or outer diameter of the conduit 104. The mesh 220 of the screen cover 110 includes the openings 222 that prevents entry of external objects into the water heater 100 while allowing the flow of air or gas therethrough.

In an implementation, the conduit 104 may have the inner diameter 'C1' equal to the first diameter 'D1' of the first diametric portion 204, in such case the first diametric portion engages with the open end 106 of the conduit 104. While the first diametric portion 204 is engaging with the conduit 104, the second diametric portion 230 may be detached from the first diametric portion 204. In another implementation, the conduit 104 may have the inner diameter 'C2' substantially equal to of the second diameter 'D2' of the second diametric portion 230, in such case the second diametric portion 230 engages with the open end 106 and the first diametric portion 204 extends outside the open end 106 of the conduit 104. Thus, the screen cover 110 of the present disclosure is adapted to attach with the conduits having different diameters and thereby manufacturing of individual protective caps for attaching with the conduits having different diameters can be avoided.

While aspects of the present disclosure have been particularly shown and described with reference to the embodiments above, it will be understood by those skilled in the art that various additional embodiments may be contemplated by the modification of the disclosed methods without departing from the spirit and scope of what is disclosed. Such embodiments should be understood to fall within the scope of the present disclosure as determined based upon the claims and any equivalents thereof.

What is claimed is:

1. A screen cover for attaching to an open end of a conduit of a water heater, the screen cover comprising:

a first diametric portion having a first diameter defining a first opening;

a second diametric portion having a second diameter defining a second opening, wherein the first diameter of the first diametric portion is greater than the second diameter of the second diametric portion, and wherein the first diametric portion and the second diametric portion are coaxially aligned and configured to allow flow of air or gas therethrough;

a shoulder portion defined between the first diametric portion and the second diametric portion; and a mesh disposed at the first opening of the first diametric portion and configured to prevent entry of external objects into the water heater through the open end of the conduit, wherein the shoulder portion comprises a tapered surface and a groove at a juncture of the tapered surface and the second diametric portion, the groove configured to detach the second diametric portion from the first diametric portion.

2. The screen cover of claim 1, wherein the mesh is integral with the first diametric portion.

3. The screen cover of claim 1, wherein the mesh is detachably attached to the first diametric portion.

4. The screen cover of claim 1, wherein the first diametric portion comprises a first outer surface defining the first diameter configured to engage with an inner surface of the open end of the conduit.

5. The screen cover of claim 4, wherein the first diametric portion comprises a flange extending radially outward from the first outer surface thereof and is proximate the first opening, the flange configured to abut a peripheral edge of the open end of the conduit.

6. The screen cover of claim 1, wherein the shoulder portion comprises:

an inclined surface extending inward with respect to a longitudinal axis of the screen cover; and a planar surface extending radially inward between the inclined surface and the second diametric portion, wherein a juncture defined by the planar surface and the second diametric portion is configured to detach the second diametric portion from the first diametric portion.

7. The screen cover of claim 6, wherein the second diametric portion comprises a second outer surface defining the second diameter configured to engage with an inner surface of the open end of the conduit, and wherein a peripheral edge of the open end of the conduit abuts the planar surface of the shoulder portion.

8. The screen cover of claim 1, wherein the second diametric portion comprises:

an inner surface configured to engage with an outer surface of the open end of the conduit; and a protrusion extending radially inward from the inner surface of the second diametric portion and proximate the shoulder portion, the protrusion configured to abut a peripheral edge of the open end of the conduit.

9. The screen cover of claim 1, wherein the first diametric portion, the second diametric portion, the shoulder portion, and the mesh are made of plastic material comprising polyvinyl chloride (PVC).

10. The screen cover of claim 1, wherein the first diameter of the first diametric portion is in a range of 55 mm to 65 mm.

11. The screen cover of claim 1, wherein the second diameter of the second diametric portion is in a range of 45 mm to 55 mm.

12. The screen cover of claim 1, wherein a length defined between the first opening of the first diametric portion and the second opening of the second diametric portion is in a range of 10 mm to 50 mm.

13. The screen cover of claim 1, wherein a first outer surface of the first diametric portion or a second outer surface of the second diametric portion is configured to engage with the open end of the conduit using an interference fit.

14. The screen cover of claim 1, wherein at least a portion of a wall of the second diametric portion is formed as a mesh, and wherein the wall of the second diametric portion allows unobstructed flow of air or gas, when the first diametric portion is engaged with the open end of the conduit.

15. The screen cover of claim 14, wherein at least some of the shoulder portion is formed as a mesh, and wherein at least the portion of the wall of the second diametric portion and the at least some of the shoulder portion are together configured to permit a flow of air therethrough when the first diametric portion is engaged with the open end of the conduit.

16. A water heater comprising:

a tank;

one or more conduits fluidly coupled to the tank and configured to allow flow of air or gas therethrough; and one or more screen covers for removably attaching to an open end of the one or more conduits, each screen cover comprising:

a first diametric portion having a first outer diameter defining a first opening;

a second diametric portion having a second outer diameter defining a second opening, wherein the first outer diameter of the first diametric portion is greater than the second outer diameter of the second diametric portion, and wherein the first diametric portion and the second diametric portion are coaxially aligned and configured to allow flow of the air or gas therethrough;

a shoulder portion defined between the first diametric portion and the second diametric portion; and a mesh disposed at the first opening of the first diametric portion and configured to prevent entry of external objects into the water heater through the open end of the conduit, wherein the first diametric portion is configured to engage with the open end of the conduit having an inner diameter equal to the first outer diameter of the first diametric portion, and wherein a peripheral edge of the open end of the conduit abuts a flange extending radially outward from a first outer surface of the first diametric portion, wherein the first diametric portion is configured to engage with the open end of the conduit having an inner diameter equal to the first outer diameter of the first diametric portion, and wherein a peripheral edge of the open end of the conduit is configured to abut a flange extending radially outward from a first outer surface of the first diametric portion.

17. The water heater of claim 16, wherein the second diametric portion is configured to engage with the open end of the conduit having an inner diameter equal to the second outer diameter of the second diametric portion, and wherein a peripheral edge of the open end of the conduit is configured to abut the shoulder portion.

18. The water heater of claim 16, wherein the second diametric portion is configured to engage with the open end of the conduit having an outer diameter equal to a diameter defined by an inner surface of the second diametric portion, and wherein a peripheral edge of the open end of the conduit is configured to abut a protrusion extending radially inward from the inner surface of the second diametric portion.

19. A screen cover for attaching to an open end of a conduit of a water heater, the screen cover comprising:

a first diametric portion having a first diameter defining a first opening;

a second diametric portion having a second diameter defining a second opening, wherein the first diameter of the first diametric portion is greater than the second diameter of the second diametric portion, and wherein the first diametric portion and the second diametric portion are coaxially aligned and configured to allow flow of air or gas therethrough;

a shoulder portion defined between the first diametric portion and the second diametric portion; and a mesh disposed at the first opening of the first diametric portion and configured to prevent entry of external objects into the water heater through the open end of the conduit, wherein at least a portion of a wall of the second diametric portion is formed as a mesh, and wherein the wall of the second diametric portion allows unobstructed flow of air or gas, when the first diametric portion is engaged with the open end of the conduit.

* * * * *